United States Patent [19]

Parish

[11] 4,422,800

[45] Dec. 27, 1983

[54] METHOD OF INSTALLING AN UNDERGROUND CONDUIT

[75] Inventor: Robert O. Parish, Houston, Tex.

[73] Assignee: Doc's Road Boring, Inc., Houston, Tex.

[76] Inventor: Robert O. Parish, P.O. Box 15170, Houston, Tex. 77020

[21] Appl. No.: 208,981

[22] Filed: Nov. 21, 1980

[51] Int. Cl.[3] ..... E21C 9/00; E21C 23/00

[52] U.S. Cl. ..... 405/184; 116/DIG. 14; 175/62; 254/29 R; 405/154

[58] Field of Search ..... 405/154, 157, 184, 174, 405/178, 161, 162, 175–177, 179–183; 175/62, 53, 56; 254/134.3 R, 134.3 FT, 134.3 SC, 134.5, 134.6, 29 R; 116/209, 200, DIG. 14

[56] References Cited

U.S. PATENT DOCUMENTS

| | | | |
|---|---|---|---|
| 2,659,335 | 11/1953 | English | 116/209 X |
| 2,903,252 | 9/1959 | Ebeling | 175/53 X |
| 3,523,515 | 10/1968 | Brown | 116/DIG. 14 |
| 3,568,626 | 3/1971 | Southworth | 405/157 X |
| 3,805,899 | 4/1974 | Hicks et al. | 175/62 X |
| 3,849,999 | 11/1974 | Coffey | 405/178 |
| 3,927,637 | 12/1975 | Sammartano | 116/DIG. 14 |
| 4,043,136 | 8/1977 | Cherrington | 405/161 |
| 4,102,413 | 7/1978 | Johnston | 175/53 |

*Primary Examiner*—Dennis L. Taylor

[57] ABSTRACT

Disclosed is a method of installing a conduit in the earth below a grade which includes the steps of pulling a cable through the earth along the course to be traveled by the conduit and marking the ends of the cable.

3 Claims, 9 Drawing Figures

METHOD OF INSTALLING AN UNDERGROUND CONDUIT

BACKGROUND OF THE INVENTION

1. Field of the Invention

This invention relates to a method of installing a conduit below a grade by boring through the earth, and more particularly, to a method that includes the steps of pulling a cable through the earth along the course to be traveled by the conduit and marking the ends of the cable.

2. Description of the Prior Art

In the laying of underground conduits, as for example pipelines, the conduit is normally laid in a trench. However, when the course of the conduit intersects a highway, railroad, or like obstruction that cannot be trenched, a pathway for the conduit must be bored through the earth under the obstruction. Such boring is typically carried out by a method that includes digging pits on either side of the obstruction, forming a small diameter pilot hole between the two pits, commonly referred to as a bore pit and a come out pit, along the course to be traveled by the conduit, reaming the pilot hole to form a radially enlarged hole having a diameter sufficient to accommodate the conduit, and running the conduit through the radially enlarged hole.

The most difficult step in boring is the formation of the pilot hole. The pilot hole must run straight and exit the come out pit within a relatively small target. It has been found to be advantageous when running multiple crossings, i.e., where multiple adjacent parallel conduits are to be run, to form a pilot hole for the next adjacent conduit, not by drilling, but by pulling a cable through the earth adjacent the conduit. The cable is pulled through the earth by means of a blade-like structure known as a wing extending radially outwardly from the conduit. The cable is attached to the wing, and as the conduit is pushed or pulled across the crossing, the wing slices through the earth and strings the cable therebehind. After the cable has been pulled across, the hole formed thereabout may be reamed to accommodate a conduit.

One problem that has plagued the boring industry is the installation of conduits adjacent previously installed conduits. Conduit easements are expensive, and it is in the easement owner's interest to maximize the number of conduits running through the easement. Accordingly, it is desirable to install conduits with a minimum of space therebetween. The desired spacing is on the order of one foot. However, it is presently virtually impossible to successfully install a new conduit closer than about three feet away from an existing conduit. This is because there exists for a radius of about three feet around an existing conduit a zone of soil that is disturbed and has an anomalous moisture content. If one attempts to drill a pilot hole within the disturbed radius, the pilot bit will drift toward the previously existing conduit. Accordingly, the pilot hole must presently be formed outside the disturbed radius.

It is, therefore, an object of the present invention to provide a method of installing a conduit adjacent a previously installed conduit without the necessity of drilling a pilot hole.

SUMMARY OF THE INVENTION

Briefly stated, the foregoing and other objects and advantages of the present invention are accomplished by pulling a cable through the earth adjacent the preexisting conduit along the course to be traveled by the proposed conduit and marking the ends of the cable. The proposed pipeline may be installed at some future time by locating the ends of the cable, reaming the hole occupied by the cable, and installing the proposed conduit therethrough.

DESCRIPTION OF THE PREFERRED EMBODIMENT

Figure 1:
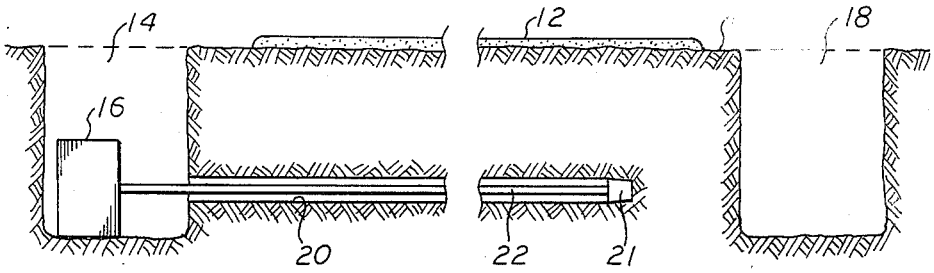
FIG. 1 is a sectional view of a piece of ground showing a method of forming a pilot hole.

Referring now to the drawings, the method of the present invention is used in connection with the installation of conduits in the ground beneath the ground surface or grade, designated by the numeral 11. Grade 11 is normally occupied by some obstruction, as for example, a road 12 which makes it impractical to lay the conduit by trenching.

Figure 2:
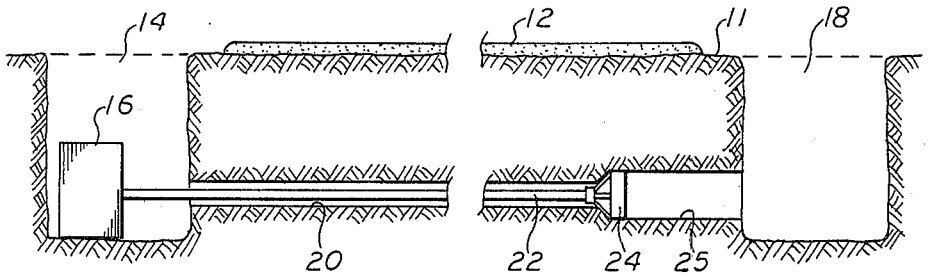
FIG. 2 is a sectional view generally similar to FIG. 1 showing a method of reaming a pilot hole.

Preparatory to installing the conduit, a first pit 14 is dug on one side of road 12 to a depth sufficient to accommodate a boring machine designated schematically in FIGS. 1 and 2 by the numeral 16. Apparatus of the type such as boring machine 16 is commercially available and typically includes means for rotating and advancing tubular members and may include fluid pumping means.

On the opposite side of road 12, there is dug a second pit 18. The second pit 18 is dug to a depth at least as deep as the depth of the conduit to be installed. First pit 14 and second pit 18 are dug to intersect the vertical plane occupied by the proposed conduit.

After first pit 14 and second pit 18 have been dug and boring machine 16 is in place, a pilot hole 20 is formed between pits 14 and 18. Pilot hole 20 is typically formed by means of a pilot bit 21 that is attached to the end of a drill stem 22. Drill stem 22 is typically composed of relatively short stands of pipe made up together and is advanced through the ground by boring machine 16.

After pilot bit 21 has emerged at second pit 18, thereby completing pilot hole 20, pilot bit 21 is replaced by a reaming tool designated by the numeral 24 in FIG.

2. Tools of the type such as reaming tool 24 are commercially available and including cutting means for increasing the diameter of holes. Reaming 24 is drawn back towards boring machine 16 to ream pilot hole 20 to form a radially enlarged hole 25 having a diameter sufficient to accommodate the conduit.

After radially enlarged hole 25 is completed, a conduit 28 may be run therethrough. According to the method of the present invention, conduit 28 is pulled through radially enlarged hole 25 by a cable 29 attached to a bull plug 30.

Figure 9:
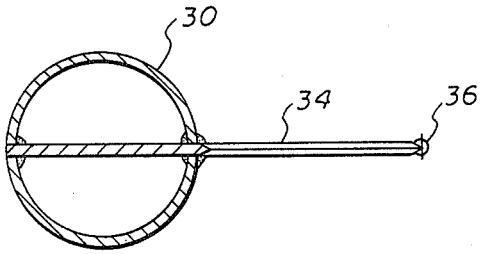
FIG. 9 is a sectional view taken along line 9—9 of FIG. 8 showing further details of the bull plug and wing.
Figure 8:
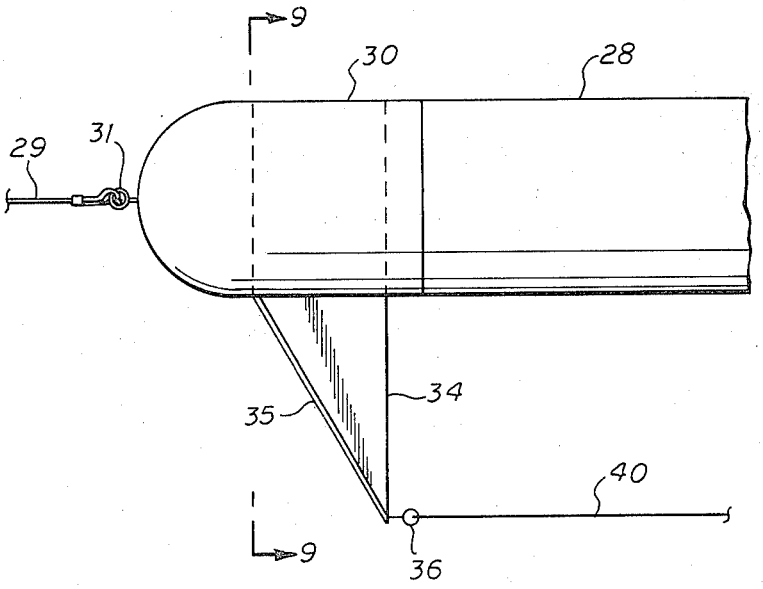
FIG. 8 is a view taken generally along line 8—8 of FIG. 3 showing details of a bull plug and wing arrangement that may be used in practicing the method of the present invention.

Referring to FIGS. 8 and 9, the bull plug 30 is a bullet headed tubular structure that is attached by welding to an end of conduit 28. Bull plug 30 has an eye 31 at the forward end thereof for the attachment of cable 29. Bull plug 30, when used to perform the method of the present invention, includes a radially extending wing 34. Wing 34 is preferably a metal plate attached by welding or the like to bull plug 30. Wing 34 includes a sharpened reawardly sloping leading edge 35 that slices through the earth as bull plug 30 is pulled through radially enlarged hole 35 at the outer end of wing 34 that is attached by means of a swivel 36 a cable 40. Those skilled in the art will recognize that the head of bull plug 30 may be of other shapes, as for example flat, and that bull plug 30 may include more than one wing 34.

Figure 3:
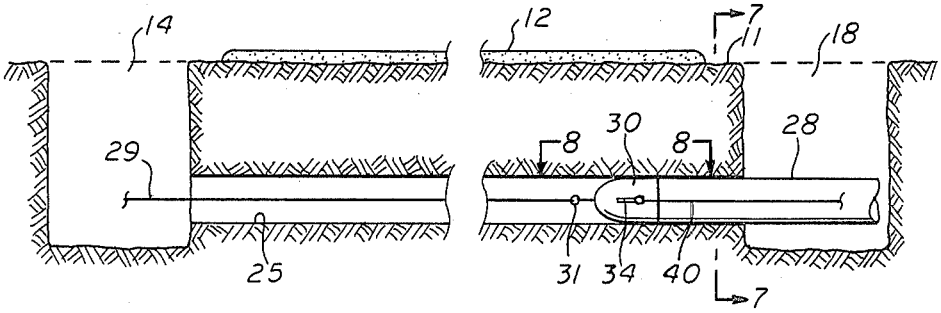
FIG. 3 is a sectional view generally similar to FIG. 2 showing the method of installing a conduit and pulling a cable through the earth adjacent the conduit.
Figure 4:
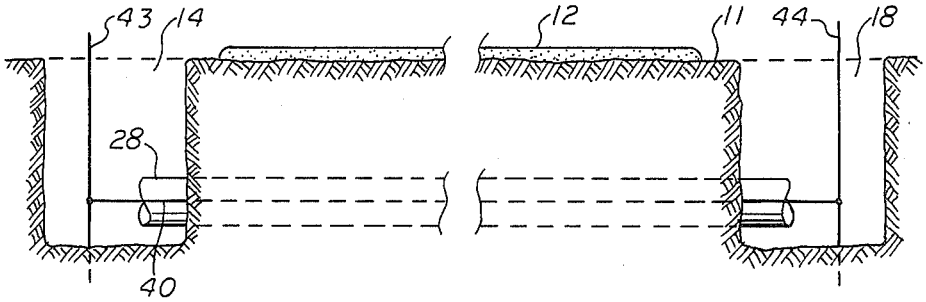
FIG. 4 is a sectional view generally similar to FIG. 3 showing the ends of a cable marked adjacent a preexisting conduit.
Figure 5:
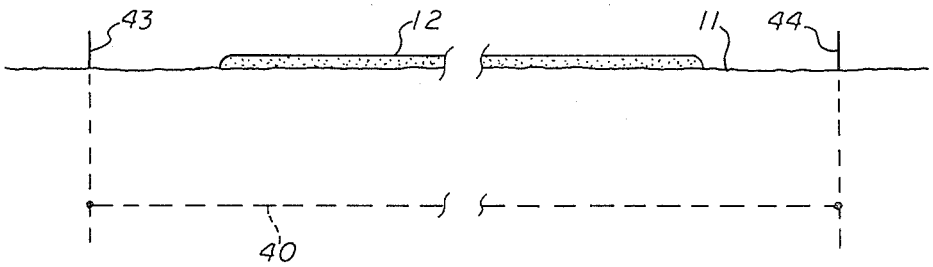
FIG. 5 is a view showing the ends of the cable marked above grade level.
Figure 7:
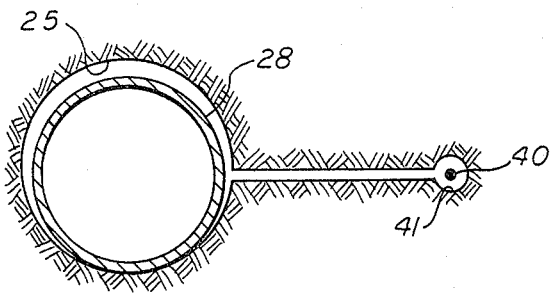
FIG. 7 is a sectional view taken along line 7—7 of FIG. 3 showing details of the cable installed according to the method of the present invention.

Returning now to FIG. 3, as bull plug 30 and attached conduit 28 are pulled through radially enlarged hole 25, cable 40 is pulled through the ground adjacent conduit 28. When conduit 28 has been pulled completely through radially enlarged hole 25, cable 40 is disposed in a small diameter hole 41 parallel to and spaced apart therefrom, as shown in FIG. 7. After cable 40 has been pulled between pits 18 and 14, the ends thereof are marked, as for example, by a pair of stakes 43 and 44, as shown in FIGS. 4 and 5. After the ends of cable 40 have been marked, pits 14 and 18 may be filled with earth back to grade level as shown in FIG. 5.

Figure 6:
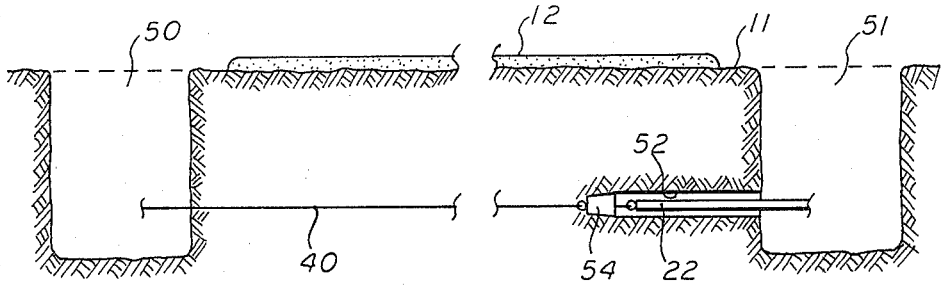
FIG. 6 is a sectional view of a section of ground showing a method of pulling a drill stem through the hole occupied by the cable.

If it is ever desired to install a new conduit adjacent conduit 28, the ground around stakes 43 and 44 may be excavated to form new pits 50 and 51 as shown in FIG. 6 to expose the ends of cable 40. A hole 52 analogous to pilot hole 20 may be formed between pits 50 and 51 by attaching to an end of cable 40 a drill stem 22. Drill stem 22 may be attached to cable 40 with a mud plug 54 having attachment swivels at either end. After hole 52 has been formed, it may be reamed in the manner heretofore described, and a new conduit run therethrough.

From the foregoing, it can be seen that the method of the present invention allows a proposed conduit to be laid adjacent a preexisting pipeline without the need for forming a pilot hole in the conventional manner. The present method allows the new pilot to be formed substantially closer to the preexisting line than was possible heretofore and allows the pilot to be formed in substantially less time.

It is to be understood that the foregoing description is to be construed as illustrative only and is for the purpose of teaching those skilled in the art the manner of carrying out the invention, and that variations and modifications of the invention may be made without departing from the spirit hereof. It is also to be understood that the scope of the invention is not to be interpreted as limited to the specific embodiments disclosed herein, but only in accordance with the appended claims when read in the light of the foregoing description.

What is claimed is:

1. A method of facilitating the future installation of a proposed conduit in the earth below a grade parallel to and spaced apart from an adjacent conduit, which comprises the steps of:

digging a first pit into said earth adjacent said grade, said first pit being located on the vertical plane that intersects the course of said adjacent conduit and having a depth at least as deep as the depth of said adjacent conduit below said grade;

and digging a second pit into said earth adjacent said grade, said second pit being spaced apart from said first pit and being located on said vertical plane and having a depth at least as deep as the depth of said adjacent conduit below said grade;

forming a pilot hold in the earth extending between said first and second pits paralled to and spaced apart from said course to be traveled by said proposed conduit;

reaming said pilot hole to form said enlarged hole having a diameter sufficient to accommodate said adjacent conduit;

attaching an end of a cable to said adjacent conduit, said end being attached radially outwardly from said adjacent conduit;

and running said adjacent conduit through the earth between said first and second pits along a course parallel to the course of said proposed conduit, thereby pulling said cable through the earth adjacent thereto;

fixing one end of said cable to a first stake;

fixing the other end of said cable to a second stake;

filling said first pit with earth of the level of said grade with said first stake exposed;

and filling said second pit with earth up to the level of said grade with the second stake exposed.

2. A method of installing in the ground below a grade between a first location and a second location a first conduit and facilitating the installation of a proposed second conduit spaced apart from and adjacent said first conduit, which comprises the steps of:

digging a first pit into the ground at said first location to a depth at least as deep as the depth at which said proposed conduit is to be installed;

digging a second pit into the ground at said second location to a depth substantially as deep as said first pit;

forming a pilot hole between said first pit and said second pit along the course to be traveled by said first conduit;

reaming said pilot hole to form an enlarged hole having a diameter sufficient to accommodate said first conduit;

attaching an end of a cable to said first conduit radially outwardly therefrom;

running said first conduit through said enlarged hole, thereby pulling said cable through the earth adjacent thereto;

marking the ends of said cable by fixing an end of said cable to a stake;

and filling the pit around said stake such that an end of said stake is exposed above ground level.

3. The method of facilitating the installation of a proposed conduit in the earth below a grade parallel to and spaced apart from a previously installed conduit which comprises the steps of:

excavating a first pit to a depth sufficient to accomodate a boring machine, excavating a second pit at least as deep as the depth of a conduit to be installed between said first pit and said second pit, placing a boring machine having a pilot bit in one of said holes and operating said boring machine to excavate a pilot hole to the other of said pits, replacing the pilot bit used to bore said pilot hole with a reaming hole when the pilot bit completes said pilot hole, drawing said reaming tool back to the pilot machine disposed in the first mentioned pit so as to form a radially enlarged hole having a diameter sufficient to accomodate a conduit, drawing a conduit through said radially enlarged hole having a radially extending wing thereon, said wing having at its remote end a cable line that is drawn through the earth at a fixed radial distance from said conduit, designating, at ground level, the ends of said cable and refilling the pits so that the position of said cable in relation to said pre-existing conduit may be readily determined in anticipation of excavating new pits at said points of designation.

* * * * *